US012781576B2

(12) United States Patent
Crowley et al.

(10) Patent No.: US 12,781,576 B2
(45) Date of Patent: Nov. 3, 2026

(54) HIGH FREQUENCY TORSIONAL OSCILLATION MITIGATION TOOL

(71) Applicant: ROCKATEK LIMITED, Gloucester (GB)

(72) Inventors: Daniel Brendan Crowley, Gloucester (GB); Robert Donald John Sedgeman, Gloucester (GB)

(73) Assignee: ROCKATEK LIMITED, Gloucester (GB)

( * ) Notice: Subject to any disclaimer, the term of this patent is extended or adjusted under 35 U.S.C. 154(b) by 0 days.

(21) Appl. No.: 19/401,975

(22) Filed: Nov. 26, 2025

(65) Prior Publication Data

US 2026/0078640 A1 Mar. 19, 2026

Related U.S. Application Data

(60) Division of application No. 18/674,480, filed on May 24, 2024, now Pat. No. 12,497,844, which is a (Continued)

(30) Foreign Application Priority Data

Mar. 10, 2021 (GB) ..... 2103282

(51) Int. Cl.
*E21B 17/07* (2006.01)

(52) U.S. Cl.
CPC ..... *E21B 17/073* (2013.01)

(58) Field of Classification Search
CPC ..... E21B 17/05; E21B 17/073; E21B 17/07
See application file for complete search history.

(56) References Cited

U.S. PATENT DOCUMENTS 3,477,302 A * 11/1969 Oswald ..... F16D 41/22 192/41 R
4,211,290 A * 7/1980 Mason ..... E21B 17/07 175/321

(Continued)

FOREIGN PATENT DOCUMENTS

| | | | |
|---|---|---|---|
| EP | 1024245 | A2 | 8/2000 |
| WO | 2004090278 | A1 | 10/2004 |
| WO | 2019232006 | A1 | 12/2019 |

OTHER PUBLICATIONS

International Preliminary Report on Patentability issued in PCT/EP2022/056245 on Jan. 26, 2023 (8 pages).

*Primary Examiner* — Shane Bomar
(74) *Attorney, Agent, or Firm* — ARC IP Law, PC; Joseph J. Mayo

(57) ABSTRACT

A high frequency torsional oscillation mitigation tool for use in a downhole drilling assembly. The tool has a first end, a second end, and a one-way coupling therebetween. The one-way coupling has a first part connected to rotate with the first end and a second part connected to rotate with the second end. The one-way coupling has an engaged condition in which the first part and the second part can rotate together in a first rotational direction whereby drill string rotation can be communicated to the drill bit. The one-way coupling has a disengaged condition in which the first part can rotate relative to the second part in a second rotational direction. The one-way coupling can have multiple sets of driving elements along its longitudinal axis. The tool can include a locking mechanism to override the one-way coupling for recovering a stuck downhole assembly.

14 Claims, 10 Drawing Sheets

Related U.S. Application Data continuation-in-part of application No. 18/550,122, filed as application No. PCT/EP2022/056245 on Mar. 10, 2022, now Pat. No. 11,993,985.

(56) References Cited

U.S. PATENT DOCUMENTS

| | | | | |
|---|---|---|---|---|
| 7,044,240 | B2 | 5/2006 | McNeilly | |
| 7,219,752 | B2 | 5/2007 | Wassell et al. | |
| 7,377,337 | B2 | 5/2008 | Swietlik et al. | |
| 7,654,344 | B2 | 2/2010 | Haughom et al. | |
| 8,739,901 | B2 | 6/2014 | Cote | |
| 10,253,584 | B2 | 4/2019 | Crowley et al. | |
| 12,435,614 | B2 * | 10/2025 | Shi | E21B 44/04 |
| 12,636,945 | B1 * | 5/2026 | Engerman | B60K 6/365 |
| 2003/0024742 | A1 | 2/2003 | Swietlik et al. | |
| 2004/0238219 | A1 | 12/2004 | Nichols et al. | |
| 2005/0194183 | A1 * | 9/2005 | Gleitman | E21B 17/07 175/45 |
| 2005/0230211 | A1 * | 10/2005 | Weilant | F16D 37/02 192/21.5 |
| 2012/0252646 | A1 * | 10/2012 | Norton | B25J 15/04 483/16 |
| 2015/0171704 | A1 * | 6/2015 | Borgen | H02K 7/12 310/101 |
| 2015/0176344 | A1 | 6/2015 | McLoughlin et al. | |
| 2015/0226020 | A1 | 8/2015 | Crowley et al. | |
| 2017/0030149 | A1 | 2/2017 | Kadam et al. | |
| 2018/0100357 | A1 | 4/2018 | Christopher et al. | |
| 2018/0172129 | A1 * | 6/2018 | Depraete | F16F 15/123 |
| 2019/0284882 | A1 | 9/2019 | Peters et al. | |
| 2020/0018124 | A1 | 1/2020 | Hohl | |
| 2021/0348452 | A1 | 11/2021 | Brooks et al. | |
| 2022/0049441 | A1 * | 2/2022 | Giannotta | E01F 11/00 |
| 2022/0052582 | A1 * | 2/2022 | Giannotta | E01C 11/265 |
| 2023/0124872 | A1 * | 4/2023 | von Gynz-Rekowski | E21B 7/04 175/61 |
| 2024/0116351 | A1 * | 4/2024 | Gurski | B60K 1/04 |
| 2025/0059875 | A1 * | 2/2025 | Johnson | E21B 44/00 |

* cited by examiner

HIGH FREQUENCY TORSIONAL OSCILLATION MITIGATION TOOL

This application is a divisional of U.S. patent application Ser. No. 18/674,480, filed on 24 May 2024, which is a continuation-in-part to U.S. patent application Ser. No. 18/550,122, filed 11 Sep. 2023, which is a 35 U.S. C. 371 National Stage Application of PCT/EP2022/056245, filed on 10 Mar. 2022, which claims priority to Great Britain Patent Application No. 2103282.6, filed on 10 Mar. 2021, the specifications of which are hereby incorporated herein by reference.

BACKGROUND OF THE INVENTION

Field of the Invention

The invention relates to a high frequency torsional oscillation mitigation tool, in particular for mitigating the high frequency torsional oscillation which can occur in a drilling operation for geothermal energy or for oil and gas. The tool is expected to find its primary utility as part of a downhole assembly including a rotary steerable tool by which the drill bit can be steered in a chosen direction.

In this application directional and orientational terms such as "top", "bottom", "below" etc. refer to the downhole assembly and tool in use in a substantially vertical borehole. The use of these directional terms does not preclude the downhole assembly being used in non-vertical boreholes.

DESCRIPTION OF THE RELATED ART

When drilling for geothermal energy or for oil and gas, the drill bit is connected to surface equipment by way of a drill string. The drill string is hollow whereby drilling fluid or mud can be pumped down the borehole, the mud acting to lubricate the drill bit and to carry drill cuttings back to the surface. The mud and entrained drill cuttings return to the surface along the outside of the drill string, the drill string being smaller than the diameter of the borehole.

In some drilling applications the drill string is rotated at the surface, with the rotation being communicated to the drill bit by the drill string. In other drilling applications a downhole motor such as a mud motor is provided, which uses the flowing mud to drive the drill bit to rotate. A downhole motor may be used with a rotating, or a non-rotating, drill string.

Some downhole motors include a bent housing and are used to steer the drill bit, the bent housing being connected to the drill string. The downhole assembly includes sensors to determine the orientation of the bend in the housing and thereby the orientation of the drill bit (below the motor) relative to the drill string (above the motor). If the orientation matches that in which it is desired to drill the motor drives the drill bit to rotate and the borehole will curve in the direction determined by the bent housing. When it is desired to change the direction of drilling the drill string and housing are rotated until the orientation of the bend matches the required new orientation. When it is desired to drill a linear section of borehole the drill string and housing are continuously rotated to cancel out the effect of the bend.

Downhole motors are relatively crude and are largely being replaced by rotary steerable tools such as that described in EP 1 024 245. As above indicated, the drill string is smaller than the diameter of the borehole and is typically centralised in the borehole. The rotary steerable tool of EP 1 024 245 is located close to the drill bit and has radial pistons which can be actuated to force the drill string away from the centre of the borehole, and thereby force the drill bit to deviate from a linear path. Rotary steerable tools can be used with rotating drill strings which permit the drilling of much deeper boreholes than non-rotating drill strings. Rotation of the drill string requires the pistons to be actuated cyclically to match the rotation of the drill string.

In addition to the torque which rotates the drill bit there is also a force acting to advance the bit into the rock at the bottom end of the borehole, the latter force typically being referred to as "weight on bit". The weight on bit is determined by the surface equipment and is dependent amongst other things upon the weight of the drill string and the inclination of the borehole.

High frequency torsional oscillation is one of the torsional dynamics phenomena which are known to occur downhole and which can damage parts of the downhole assembly. The other well-known torsional dynamics phenomena are stick-slip and low frequency torsional oscillation. Stick-slip and low frequency torsional oscillation are both understood to occur typically at less than 2 Hz (approx.), whereas high frequency torsional oscillations are understood to occur typically at between 50 and 500 Hz (approx.).

The drill operator will usually seek to maximise the weight on bit so that the drill advances as quickly as possible through the rock. However, there is a maximum limit for the weight on bit which depends upon the bit design and the drilling conditions. Exceeding the maximum weight on bit for the particular bit design and drilling conditions will increase the drag upon the drill bit and cause the drill bit to slow down or stall.

If the drill bit rotates more slowly than the drill string, or more slowly than the output of the downhole motor, then the drill string will be caused to twist as torque output from the surface equipment (or downhole motor) increases in response to maintain the original rate of rotation. Eventually, torque at the drill bit will exceed the resistance to rotation and the rate of rotation of the drill bit will increase.

This is the phenomenon known as stick-slip and in some cases this includes the drill bit temporarily stalling. Drill operators seek to avoid stick-slip by reacting to reductions in the rate of rotation of the drill bit by reducing the weight on bit, so that the drill bit resumes its desired rate of rotation quickly without excessive twisting of the drill string. Torque control devices which can automatically reduce the weight on bit if the torque exceeds a certain threshold are known, for example WO 2004/090278 (Tomax), U.S. Pat. No. 7,044,240 (McNeilly), U.S. Pat. No. 7,654,344 (Tomax), and U.S. Pat. No. 10,253,584 (Crowley/Walker).

Low frequency and high frequency torsional oscillations differ from stick-slip and are both types of resonance in the drill string. Low frequency torsional oscillation is rarely damaging to a downhole assembly and the present invention is not concerned with that aspect of torsional dynamics.

All systems have resonant frequencies and high frequency torsional oscillation usually comprises torsional resonance in the downhole assembly and drill string at one or more harmonics. High frequency torsional oscillation is typically the most damaging form of torsional dynamics and is understood to be particularly prevalent when drilling through hard carbonate formations. The high frequency torque and RPM fluctuations are often attenuated as they travel up the drill string and are often not measurable at the surface. Downhole sensors are therefore usually required to provide real-time information, without which the high frequency torsional oscillation can quickly cause extensive damage including premature failure of the downhole assembly, including in particular damage to a rotary steerable tool and to polycrystalline diamond compact (PDC) drill bits.

It is possible to damp or otherwise mitigate resonance if the resonant frequency is known; however, in practice there is a difference between the theoretical natural frequency of the system and the real-life damped natural frequency of the system. Furthermore, there is the added complication that some instances of high frequency torsional oscillation arise in response to a single stimulus whereas others arise in response to a continual periodic stimulus.

A further complication in a downhole drilling application is that the "system" comprises the drill string and the downhole assembly (which can both be well-modelled) and also the formation borehole, the drilling fluid and the influence of (non-obvious) external parameters such as weight on bit. These latter influences typically cannot be well-modelled and they significantly complicate the theory and calculations needed to characterize (and therefore damp or otherwise mitigate) the resonance.

The most basic model to explain torsional resonance behaviour has a single degree of freedom, for example a disc on a shaft, the shaft being supported at one of its ends. As the disc oscillates following a single induced rotational stimulus in which the shaft is twisted to a chosen degree, energy is transferred between potential energy stored in the twisted shaft and kinetic energy of the rotating disc and shaft. In a practical situation there are losses associated with the system such as hysteresis in the material and viscous drag against the fluid surrounding the system. These losses result in damping that causes the amplitude of the oscillations to reduce. Calculations to determine the natural frequency for such a basic system are relatively straightforward, even for shafts of varying cross sections and varying material stiffnesses and densities.

A development of this basic model is to change to a "forced" vibration system. In this case, repeated stimuli are applied to the system at or close to the resonant frequency. If the input force exceeds the damping the degree of twist in the shaft increases with every cycle. In this case the system will continue to oscillate and the amount of twist (and associated stresses) will increase until some form of failure occurs or the stimulus is removed (or its frequency changes).

With the increasing application of rotary steerable tools and a desire to drill ever faster, downhole assemblies are becoming more mechanically complex and more sensitive to adverse events downhole, such as in particular the damaging effects of high frequency torsional oscillation. There is also a general increase in the depth (length) of boreholes, with the result that there is a greater length of drill string which can twist and store potential energy; the increased potential energy can be transferred into an increased amount of kinetic energy and thereby increase the likelihood of damage to the drill string and/or downhole assembly.

There is also competition driving down costs and increasing the required rate of penetration (ROP) for a drilling operation, with the result that rotary steerable tools are now operating in environments, and under performance drilling parameters, that ultimately mean that the tools must be able to withstand some or all of the extreme power dissipated in the downhole assembly during high frequency torsional oscillation.

BRIEF SUMMARY OF THE INVENTION

It is an object of the present invention to mitigate the damaging effects of high frequency torsional oscillations in a downhole assembly, in particular during drilling for geothermal energy or for oil and gas. It is known to use torque limiting tools such as those of Tomax and others as described above in a downhole assembly. The present invention differs from this approach as it functions independently of weight on bit and drilling torque.

According to a first aspect of the invention there is provided a high frequency torsional oscillation mitigation tool having: a first end, a second end, and a one-way coupling between the first end and the second end, a first connector at the first end and a second connector at the second end, the one-way coupling having a first part and a second part, the first part being connected to rotate with the first connector and the second part being connected to rotate with the second connector, the one-way coupling having an engaged condition in which the first part and the second part can rotate together in a first rotational direction and a disengaged condition in which the first part can rotate relative to the second part in a second rotational direction, the tool having a longitudinal axis with a set of driving elements around the longitudinal axis and multiple sets of driving elements along the longitudinal axis.

The set of driving elements is located around the longitudinal axis in order to provide a balanced transmission of torque between the first part and the second part in the engaged condition.

In a practical application in which the high frequency torsional oscillation mitigation tool is part of a downhole assembly, the uphole end of the tool is connected directly or indirectly to the drill string and the downhole end of the tool is connected directly or indirectly to the drill bit. During normal operation the tool must transmit significant torque from the drill string to the drill bit and therefore between the first part and the second part of the one-way coupling. The tool is relatively narrow so there is limited radial space in which to locate the driving elements; the driving elements therefore typically have a significant overall length, for example 400 mm to 600 mm, in order to transmit the required torque. It will be understood that a practical high frequency torsional oscillation mitigation tool in use downhole will typically twist along its length due to the applied torque, and will also bend as it passes along a curved borehole. The twisting and bending actions can significantly affect the operation of the driving elements and the torque they are able to transmit. Utilising multiple sets of (relatively short) driving elements along the longitudinal axis reduces the requirement for individual driving elements to twist and bend and therefore maximises the torque that can be transmitted despite twisting and bending of the mitigation tool in use.

The high frequency torsional oscillation mitigation tool is expected to have its greatest utility as part of a downhole assembly including a rotary steerable tool or other downhole component which is sensitive to high frequency torsional oscillation. The high frequency torsional oscillation mitigation tool is preferably located above the rotary steerable tool in the downhole assembly. Alternatively stated, the rotary steerable tool is located between the drill bit and the high frequency torsional oscillation mitigation tool.

The one-way coupling communicates input rotation at the first connector to output rotation at the second connector in a non-uniform manner dependent upon the direction of rotation. In a typical application the first and second connectors are pin connectors or box connectors of standardised form.

A perfect the one-way coupling communicates 100% of input rotation from the first part to the second part (i.e. without any loss) in the first rotational direction, and communicates 0% of the input rotation from the first part to the second part (i.e. zero output rotation) in the second rotational direction opposed to the first rotational direction. In most practical applications, however, it is expected that there may be some transfer of input rotation to output rotation in the second rotational direction, albeit with reduced torque capability. Nevertheless, it will be understood that the transfer of kinetic energy during high frequency torsional oscillation from the drill string and/or from the uphole parts of a downhole assembly to the steering tool (or other parts of the downhole assembly) will be significantly altered by the presence of a one-way coupling which avoids (or at least significantly reduces) the transfer of rotation in the second rotational direction.

It is expected that the one-way coupling will act to prevent the onset of damaging high frequency torsional oscillation (for example in a downhole assembly) by preventing the kinetic energy of those oscillations being communicated through the mitigation tool (and therefore throughout the downhole assembly), and in turn preventing the build-up of potential energy. However, even if a proportion of the kinetic energy is transferred, it is expected to be sufficiently reduced to avoid damage to the downhole assembly and in particular to avoid damage to other parts of a downhole assembly such as a rotary steerable tool.

It will be understood that the first rotational direction corresponds to the normal direction of rotation of the tool, which in a downhole assembly is typically clockwise when viewed in the downhole direction towards the drill bit) whereby the normal rotation of the drill string can be communicated to the rotary steerable tool and to the drill bit.

The one-way coupling will be effective in a downhole assembly whether the high frequency torsional oscillation is generated at the drill bit (i.e. below the mitigation tool) or in the drill string or uphole parts of the downhole assembly (i.e. above the mitigation tool). In both cases, because the one-way coupling lies within the resonant system it will reduce the likelihood of high frequency torsional oscillation which is generated at the drill bit passing to the uphole parts of the downhole assembly and drill string where it can build up to damaging levels, and it will reduce the likelihood of any damaging high frequency torsional oscillation which has built up in the downhole assembly or drill string from passing to the rotary steerable tool. Whilst high frequency torsional oscillation can in principle be generated throughout the system it is likely to be the downhole assembly where the resonance will cause the build-up of energy to damaging levels for the high value parts of the assembly such as rotary steerable systems and logging while drilling tools.

It is understood that the top of the downhole assembly is a typical reflection point for high frequency torsional strain waves. Also, the length of the downhole assembly is directly related to the resonant frequency of the system. Because the high frequency torsional oscillation mitigation tool is located in the downhole assembly it is understood that activation of the tool significantly alters the boundary conditions of the resonant system and in doing so significantly interrupts the transfer and reflection of torsional strain.

The one-way coupling may comprise a one-way clutch, a sprag clutch, a sprag bearing, an over-run clutch, an over-run bearing, a ratchet bearing, a ratchet clutch, a roller clutch, a pawl bearing, a freewheel clutch or a pawl clutch. Whilst some of these terms are synonymous, and there is some overlap between certain of these devices, they all operate in similar ways to permit relative rotation in one rotational direction (whereby to transfer little or no input rotation to output rotation) and to avoid relative rotation in the other rotational direction (whereby to transfer most or all input rotation to output rotation). Many different detailed structures could be used in a practical mitigation tool depending upon the characteristics of its intended use (and the above list of one-way couplings is not exhaustive).

A one-way coupling (or freewheel clutch) comprising a set of driving elements arranged around the longitudinal axis of the coupling is known to be used in a downhole application as described in U.S. Pat. No. 7,377,337. The freewheel clutch is located between a downhole motor and the drill bit, the downhole motor being connected to a rotating drill string. The clutch is normally disengaged and allows the drill bit to rotate at a faster rate than the drill string, the drill bit being driven by the rotating output shaft of the downhole motor (in addition to the rotating drill string). If, however, the drill bit slows or stalls the downhole motor will similarly slow or stall. As soon as the rate of rotation of the drill bit drops below the rate of rotation of the drill string the clutch engages and the drill bit is driven to rotate by the drill string (the drill string being able to deliver significantly more torque than the downhole motor).

The present invention in certain aspects is distinguished from U.S. Pat. No. 7,377,337 in that it is normally engaged, i.e. the one-way coupling communicates normal rotation of the drill string to the steering tool and drill bit; the one-way coupling is only disengaged during a high frequency torsional oscillation event. It will be understood that the one-way coupling typically wastes less energy when it is engaged than when it is disengaged; when it is disengaged waste heat is generated in the relatively rotating components of the coupling and it is generally preferable for the one-way coupling to be engaged (i.e. without any relatively-rotating components) during normal operation. The one-way coupling also suffers less wear if there is no relative rotation of its components in normal operation.

The present invention is also distinguished from U.S. Pat. No. 7,377,337 in that it does not require a downhole motor. A downhole motor comprises a rotor and a stator. The rotor and stator are rotationally interconnected only by the downhole fluid within the motor and there is no fixed rotational mechanical connection between these components. As described above, U.S. Pat. No. 7,377,337 operates as the drill bit slows or ultimately stalls. The maximum torque which can be transmitted from the drill string to release a stalled (or stuck) drill bit is limited by the downhole motor and will reduce over time due to wear of the components. A direct mechanical connection between the drill string and the drill bit as provided by the one-way coupling of the present invention is significantly better suited to releasing a stuck drill bit.

The high frequency torsional oscillation mitigation tool can be lubricated by oil, by the downhole fluid (mud), or by a combination of these. In one embodiment the one-way coupling and the associated bearings are lubricated by oil. In another embodiment the one-way coupling and the bearings are lubricated by downhole fluid. In yet another embodiment the one-way coupling is lubricated by oil and the bearings are lubricated by downhole fluid.

In embodiments using downhole fluid as a lubricant a fluid conduit connects the relatively rotating parts of the tool to the mud flowing down the centre of the tool. In embodiments using oil the oil is isolated from the mud and the tool preferably includes a flow restrictor to reduce the local mud pressure and a pressure equaliser or compensator, suitably a sliding piston, to equalise (or at least substantially equalise) the pressure of the oil with the pressure in the surrounding mud.

Radial bearings are preferably located above and below the one-way coupling. Needle roller bearings are preferably used if lubricated by oil. Thin-walled tungsten carbide sleeves such as those typically used in downhole motors are preferably used if lubricated by downhole fluid.

Axial bearings are preferably located below the one-way coupling. Cylindrical roller thrust bearings are preferably used if lubricated by oil. Ball bearing stacks are preferably used if lubricated by downhole fluid.

A downhole assembly can if desired include two high frequency torsional oscillation mitigation tools, one located above (uphole of) and one located below (downhole of) a rotary steerable tool (or other sensitive component). The use of two mitigation tools gives the capability of changing the boundary conditions of the torsional resonance behaviour at two locations. The uphole high frequency torsional oscillation mitigation tool can isolate the rotary steerable tool and drill bit from the drill string; the downhole high frequency torsional oscillation mitigation tool can isolate the rotary steerable tool and drill string from the drill bit.

The driving elements can comprise rolling elements located in respective radial recesses. The rolling elements can be cylindrical rods of circular cross-section, or spheres (ball bearings), or other shapes having a consistent rolling radius. One other such shape is known as a Reuleaux triangle which despite its non-spherical shape has a consistent rolling radius. The high frequency torsional oscillation mitigation tool is configured such that the rolling elements can roll within their recesses between the engaged condition in which they transmit torque from the first connector to the second connector, and the disengaged condition in which they do not transmit torque (or at least transmit significantly less torque) from the first connector to the second connector.

The one-way coupling can if desired utilise a mixture of different types of rolling element in the respective recesses, or in each recess, as desired.

Notwithstanding the possible use of rolling elements of other shapes, cylindrical rods and spheres are preferred because they are less likely to suffer from regions of localised high-stress during use.

Preferably, the first part of the one-way coupling is a shaft and the second part of the one-way coupling is a sleeve surrounding the shaft. It will be understood that in a downhole apparatus the shaft can be tubular whereby to communicate drilling fluid from the surface to the drill bit. Preferably also, the radial recesses are formed in the shaft or in the sleeve. The floor of each recess is preferably inclined from a radially shallower end to a radially deeper end. The depth of the recesses at the shallower end is less than the diameter of the rolling elements whereby the rolling elements project from the recesses. It is arranged that when the rolling elements are at the shallower end of the recesses they engage the other of the sleeve and shaft whereupon the sleeve and shaft rotate together in the first rotational direction. When located at the deeper end of the recesses, however, the rolling elements do not engage the other of the sleeve and shaft and rotation of the shaft (or sleeve) in the second rotational direction is not communicated to the sleeve (or shaft, respectively).

In embodiments in which the rolling elements are located in recesses of the shaft they move outwardly into their engaged condition in which the one-way coupling communicates rotation. In embodiments in which the recesses are formed in the surrounding sleeve the rolling elements move inwardly to engage the shaft in their engaged condition.

The recesses are preferably aligned with the longitudinal axis of the tool and can be continuous; the rolling elements are nevertheless discontinuous whereby to provide multiple (relatively short) rolling elements along the longitudinal axis. In some embodiments the shaft or sleeve in which the recesses are formed can comprise multiple relatively short shaft elements or sleeve elements respectively. The recesses of each element can be aligned whereby the recesses are effectively continuous along the tool, or the recesses can be misaligned whereby the recesses and their (single or multiple) rolling elements of one shaft or sleeve element are isolated from the neighbouring recesses and rolling element(s). It will therefore be understood that it is the form and number of rolling elements which is relevant to the torque which can be transmitted, and not the physical arrangement of the rolling elements along the tool. The isolated recesses can therefore be arranged in any chosen configuration, including for example a staggered array along and/or around the tool if desired.

In addition the detailed structure of the recesses can be consistent along the length of the tool, or the detailed structure can differ along the tool in order to vary the torque transfer at different points along the length of the tool, the latter perhaps enabling a more uniform torque transfer to be achieved over the complete length of the tool.

It is a feature of multiple rolling elements located in multiple recesses around the longitudinal axis that they operate largely independently of each other. Also, the rolling elements are relatively tolerant of variations in the gap between the shaft and sleeve, and therefore tolerant to the variations in concentricity between the shaft and sleeve which can occur in a downhole tool in use.

The individual shorter rolling elements arranged along the longitudinal axis are also relatively independent of the other rolling elements, even neighbouring rolling elements in the same recess.

The driving elements can alternatively be sprags. Sprags are used in many mechanical one-way clutches and can be used with the present high frequency torsional oscillation mitigation tool. Sprags are not herein defined as "rolling elements" because they do not have a consistent rolling radius and instead have a major axis and a minor axis. When located in a gap between two relatively movable components such as a shaft and a sleeve, the sprags can pivot between a disengaged condition in which their minor axis is radial and does not span the gap, and an engaged condition in which their major axis is radial (or at least more radial) and spans the gap, the sprags communicating torque between the shaft and the sleeve. Whilst sprags can be used as the driving elements in a practical high frequency torsional oscillation mitigation tool, they are less tolerant of variations in concentricity between the shaft and the sleeve. If, for example, the shaft becomes slightly misaligned from the central axis of the sleeve the torque will not be equally shared among the sprags, resulting in uneven wear and perhaps tool failure. The sprags also do not operate independently of each other, so that the failure of one sprag (for example tipping beyond the point at which its major axis is radial) will directly affect the neighbouring sprags.

One benefit of sprags, however, is that they do not require recesses to be formed in the shaft or sleeve and instead those surfaces can be plain circular features.

Preferably, the first and second parts of the one-way coupling are separated in a radial direction (relative to the longitudinal axis of the high frequency torsional oscillation mitigation tool). Preferably there is a radial gap between the first part and the second part (e.g. between the shaft and the sleeve); a radial gap reduces or prevents the frictional losses which would occur if the first and second parts have cooperating sliding surfaces.

In embodiments utilising rolling elements, the depth of the recess at the deeper end is preferably greater than the diameter of the rolling elements. It is nevertheless possible for the depth at the deeper end to be less than the diameter of the rolling element provided that there is a radial gap between the shaft and the sleeve and the roller element does not project far enough from the recess to span the radial gap at the deeper end.

Preferably, there is a resilient biasing means engaging the rolling element and urging the rolling element towards the shallower end of the recess. The one-way coupling is therefore resiliently biased to its engaged condition. It is arranged that rotation of the body relative to the sleeve (in the second rotational direction) causes the rolling elements to move to the deeper end of their respective recesses and to overcome the resilient biasing means.

The resilient biasing means is preferably a cantilever spring but the invention can alternatively utilise a canted spring, an elastomer, or a bent metal (e.g. accordion) spring for example. It will be understood that the roller elements typically span a significant length so that they can accommodate the torque during a typical drilling operation (perhaps being around 400 mm to 600 mm long in practical tools). It will also be understood that if the rolling elements are spherical a set of rolling elements is arrayed along the length of the tool. Similarly, in embodiments in which the rolling elements are cylindrical rods, a set of shorter cylindrical rods is arrayed along the length of the tool.

It is preferable that the resilient biasing means engages and biases the set of rolling elements along substantially their full length so that the resilient biasing means is also of significant length in practice. Twisting and/or bending of the resilient biassing means is less likely to have a significant effect but each resilient biassing means may also comprise a set of aligned shorter spring elements. A cantilever spring is particularly suitable because it can be made to any chosen length and have a profile to match the space available and to provide the spring force required.

Preferably, the high frequency torsional oscillation mitigation tool is releasably connected to a rotary steerable tool and the other parts of a downhole assembly. The mitigation tool may be connected directly to a rotary steerable tool, or alternatively to an additional downhole component such as a stabiliser, or measurement while drilling (MWD) or logging while drilling (LWD) equipment comprised in the downhole assembly.

Desirably, the first connector is rigidly (and perhaps integrally) connected to a body forming a tubular shaft of the mitigation tool, and the second connector is rigidly (and perhaps integrally) connected to a sleeve surrounding at least part of the central tubular shaft. The one-way coupling preferably acts between the shaft and the sleeve, i.e. the relatively rotatable components of the one-way coupling are separated in a radial direction. It is preferable to have the relatively-rotatable components separated radially rather than longitudinally (for example) so that they do not need to withstand the significant forces providing the weight on bit.

Desirably the first connector and the second connector are each a pin connector or a box connector, suitably of standard form for the downhole assembly. Thus, the mitigation tool can have a pin connector at its uphole end and a box connector at its downhole end in use (or vice versa). Alternatively, the mitigation tool can have a pin connector at its first and second ends, or a box connector at its first and second ends, the connections being provided as required for connection to the other parts of the downhole assembly.

According to a second aspect of the invention there is provided a high frequency torsional oscillation mitigation tool having: a first end, a second end, and a one-way coupling between the first end and the second end, a first connector at the first end and a second connector at the second end, the one-way coupling having a first part and a second part, the first part being connected to rotate with the first connector and the second part being connected to rotate with the second connector, the one way coupling having an engaged condition in which the first part and the second part can rotate together in a first rotational direction and a disengaged condition in which the first part can rotate relative to the second part in a second rotational direction, the tool having a locking mechanism for the one-way coupling.

It will be understood that the mitigation tool is designed to transmit the normal rotation of the drill string to the rotary steerable tool and drill bit in the first rotational direction (e.g. clockwise), and to accommodate the torque driving that rotation. It will also be understood that there is a limit to the torque which can be accommodated, which limit depends upon many factors including the size of the tool, the material of the tool and friction effects. The tool would ordinarily be designed to transmit sufficient torque for all normal drilling operations plus a suitable overhead to allow for future increases in drilling torque and for situations in which the operator seeks to transmit excess torque beyond the tool's stated capacity.

In addition, and in common with other downhole tools, the high frequency torsional oscillation mitigation tool will have a specified maximum survivable limit. The tool is not designed to operate at (or close to) its survivable limit but this limit is specified so that operators know how much force can be applied to the tool in extreme situations, for example to pull the tool out of the borehole if the drill bit or part of the downhole assembly below the mitigation tool becomes stuck, for example due to a swollen or collapsed borehole (and when the only requirement is typically to retrieve the downhole assembly). The survivable limit usually includes separate limits for tensile pull, torsion load and the amount of bending which the tool can withstand before a catastrophic failure occurs, for example the tool breaks up downhole, which failure could prevent further drilling of the borehole.

The locking mechanism for the one-way coupling forms a part of the "survival" mechanism for retrieving the downhole assembly and does not affect or contribute to the normal operation of the mitigation tool.

In the event that the drill bit (or any part of the downhole assembly below the mitigation tool) becomes stuck in the borehole, the usual option for the operator is to pull the drill string up the borehole to seek to release the stuck component. The tension applied to the drill string will usually be significantly higher than in normal operations, and is often called "overpull". The operator may also rotate the drill string to seek to rotate the stuck component. In some cases the operator might pull and rotate the drill string at the same time. The locking mechanism can utilise the overpull.

Preferably, the mitigation tool has a shaft which is axially movable relative to a surrounding sleeve, the shaft being relatively movable between a normal position and a locking position. The locking mechanism has a locked condition and an unlocked condition. It is arranged that when the shaft is in the normal position relative to the sleeve the locking mechanism is in its unlocked condition. Conversely, when the shaft is in the locking position relative to the sleeve the locking mechanism is in its locked condition. Axial movement of the shaft relative to the surrounding sleeve between the normal position and the locking position therefore transfers the locking mechanism from its unlocked condition to its locked condition.

Preferably, in the locked condition the mitigation tool communicates all of the input rotation from the drill string above the mitigation tool to output rotation of the steering tool (and drill bit) below the mitigation tool. The locking mechanism in its locked condition thereby provides a rigid connection between the uphole and downhole ends of the mitigation tool and effectively bypasses or overrides the one-way coupling. The torque which the mitigation tool can accommodate in its locked condition, and which can be utilised to release a stuck tool, is therefore determined by the locking mechanism. That torque can far exceed the normal torque required to be transmitted by the one-way coupling. The locking mechanism can therefore provide a predetermined torque capability to match the requirements of the particular drilling operation, and in particular to determine the survival limit of the torque capacity for the downhole assembly.

Desirably, the locking mechanism comprises cooperating sets of selectively interlocking elements such as gears, preferably dog gears (or castellations). Desirably also one set of elements is rigidly connected to (or integral with) the shaft of the mitigation tool and the other set of elements is rigidly connected to (or integral with) the sleeve. The interlocking elements are normally separated to permit relative rotation of the shaft and sleeve for the one-way coupling to operate as required. The interlocking elements can, however, be brought together to lock the shaft and sleeve together. It will be understood that there are many different types of selectively interlocking elements which could be used and the invention is not limited to any particular form. In addition to dog gears, splined teeth, shear pins, Hirth couplings, clutch plates and mating tapered components (for example) could be used.

In the event that the locking mechanism also fails (for example the operator applies more torque than the mechanism can withstand, parts of the interlocking elements will break or shear. The maximum torque capacity of the locking mechanism is determined by the number and size of the interlocking elements, and the material from which they are made. In the event that the locking mechanism fails because too much torque has been applied, it is relatively easy for the operator to determine that after the event, and therefore to understand why the tool failed.

Preferably, the locking mechanism has a resilient biasing means to bias the locking mechanism to its unlocked condition. The resilient biasing means is typically a very strong spring which maintains the locking mechanism in its unlocked condition unless an overpull is applied to the drill string. The tension required to overcome the spring and lock the mechanism can therefore be predetermined and specified. The resilient biasing means is preferably a stack of disc springs, but could alternatively be a wire wound compression spring or a machined spring for example.

The interlocking elements are preferably tapering or sloping to encourage them to mesh together as the locking mechanism moves to its locking condition.

The resilient bias means allows the locking mechanism to move to its unlocked condition when the overpull is released. Thus, it may be possible for the operator to resume drilling once the stuck component has been released and it is desirable that the one-way coupling can automatically return to operation without having to bring the downhole assembly to the surface.

In embodiments having a shaft surrounded by a sleeve and with driving elements which act between the shaft and sleeve, the material of the shaft and sleeve will ideally be hardened in order to increase the torque which can be transmitted. However, to reduce the cost of the high frequency torsional oscillation mitigation tool the shaft can include an outer collar of hardened material and the sleeve can include an inner collar of hardened material. In such arrangements only the collars need to be made from hardened materials required for the one-way coupling.

The provision of a hardened collar for the shaft and/or sleeve will also facilitate the manufacturing process because it is significantly easier to machine relatively thin collars of hardened material rather than to machine the much thicker shaft and sleeve. This arrangement will be particularly beneficial in embodiments utilising rolling elements in which the recesses will be machined in a collar.

As previously stated the shaft or sleeve in which the recesses are formed can comprise multiple relatively short elements arranged along the length of the tool. If a hardened collar is used the shaft and sleeve can be continuous along the length of the tool and the collar can be made up of multiple relatively short elements. This arrangement can further benefit the machining of the tool's components.

The high frequency torsional oscillation mitigation tool can if desired include a damping mechanism. A damping mechanism can reduce the shock loading which occurs during transfers of the mitigation tool from the disengaged condition to the engaged condition. Alternatively stated, the damping mechanism reduces the size and effect of torque spikes inside the mitigation tool which can occur when the driving elements move to the engaged condition, thereby reducing wear and possible damage to components of the mitigation tool and to connected components in a downhole assembly.

A damping mechanism will necessarily slow down the reaction of the tool to high frequency torsional oscillations, but provided that the degree of damping is chosen appropriately it will not significantly affect the tool's ability to mitigate the effect of high frequency torsional oscillations. Accordingly, it is expected that an appropriate level of damping can be chosen for the tool which will provide protection against shock loading whilst still allowing the tool to react quickly to high frequency torsional oscillations.

A damping mechanism has another benefit, namely preventing the tool "freewheeling" in the second rotational direction. In particular, a damping mechanism will increase the torque which is transmitted across tool in the disengaged condition. In this respect, it can be disconcerting to an operator if a part of the tool rotates relatively freely during installation into a downhole assembly at the surface, and the relatively free rotation can lead some operators to believe that the tool has failed. The damping mechanism can be selected to resist relative rotation between the first part and the second part below a predetermined torque. The predetermined torque could for example be set above the torque which a person can reasonably impart by hand.

The damping mechanism can comprise a mechanical clutch utilising friction between relatively sliding clutch surfaces. Alternatively the damping mechanism can comprise a fluid damper such as a viscous coupling, the viscous coupling perhaps utilising the lubricating fluid for the mitigation tool. Alternatively again the damping mechanism could comprise a flexible and resilient material such as rubber.

If desired, the high-frequency torsional oscillation mitigation tool can include electrical wiring. The electrical wiring can connect to sensors in the mitigation tool itself, or it can simply pass electrical power and/or signals from the first end to the second end whereby to electrically interconnect other parts of a downhole assembly, including for example a MWD or LWD tool.

Optional features which are described in relation to one aspect of the invention can be used in the other aspect of the invention where compatible.

BRIEF DESCRIPTION OF THE DRAWINGS

The invention will now be described in more detail, by way of example, with reference to the accompanying drawings, in which.

DETAILED DESCRIPTION OF THE INVENTION

Figure 1:
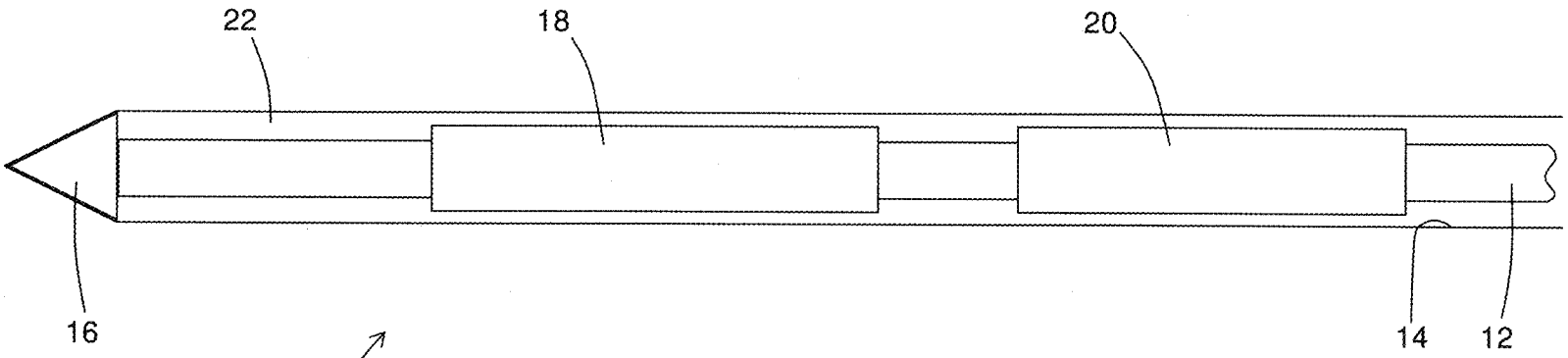
FIG. 1 shows a schematic representation of a downhole assembly according to the invention, connected to a drill string.

FIG. 1 shows a schematic representation of a downhole assembly 10 connected to a drill string 12 in a borehole 14. The downhole assembly comprises a drill bit 16, a rotary steerable tool 18 and a high frequency torsional oscillation mitigation tool 20. In FIG. 1 the borehole 14 is shown to be horizontal but that is not necessarily the case and the borehole could alternatively be vertical or at another angle.

In known fashion, the drill string 12 is connected to surface equipment (not shown), the surface equipment including means to rotate the drill string 12 and drill bit 16 in use. The drill string 12 is hollow whereby drilling fluid (mud) can be pumped down the borehole, the mud acting to lubricate the drill bit 16 and to carry drill cuttings back to the surface. The mud and entrained drill cuttings return to the surface along the annulus 22 surrounding the drill string.

In certain applications the downhole assembly may also contain a downhole (mud) motor which can provide at least some of the rotational force to the bit. The tool 20 may be located above or below the motor as desired.

A number of stabilizers will typically be provided along the length of the drill string 12 to centralise the drill string in the borehole 14. There may also be a "near-bit" stabilizer between the drill bit 16 and the rotary steerable tool 18 if desired, and perhaps also a stabilizer between the rotary steerable tool 18 and the high frequency torsional oscillation mitigation tool 20. It is expected, however, that in most applications the high-frequency torsional oscillation mitigation tool 20 will be connected directly to the rotary steerable tool 18 and/or any additional measurement while drilling (MWD) or logging while drilling (LWD) equipment comprised in the downhole assembly.

The rotary steerable tool 18 may be constructed according to EP 1 024 245, although the invention is not limited to any particular rotary steerable tool. As above described, a rotary steerable tool can steer the drill bit 18 in a desired direction by forcing the rotating drill string away from the centre of the borehole 14 in a chosen direction.

The components which extend from the rotary steerable tool 18 to engage the borehole 14 and force the drill string 12 away from the centre of the borehole are not shown in FIG. 1 for simplicity (and because the many different specific componentries will be well-known to a skilled person).

The high frequency torsional oscillation mitigation tool 20 can carry stabilizer blades to centralise it in the borehole if desired. Alternatively, its radial position is determined by the rotary steerable tool 18, and/or by a stabilizer above (or below) the mitigation tool 20. It may in certain applications be desirable for the tool to carry stabilizer blades (or otherwise engage the borehole) as any surface of the tool which rubs against the borehole surface in use provides a frictional contact which causes drag and dissipates energy in the form of heat.

As above indicated, if desired the downhole assembly can include two high frequency torsional oscillation mitigation tools 20, i.e. with another tool 20 between the drill bit 16 and the rotary steerable tool 18.

Detailed structures of eight embodiments of a high frequency torsional oscillation mitigation tool 120, 220, 320, 420, 520, 620, 720 and 820 are shown in the Figures; it will be understood that these embodiments are representative of the many different detailed structures which are encompassed by the present invention. All of the embodiments are represented in an orientation corresponding to that of FIG. 1, i.e. with the uphole end to the right and the downhole end to the left as drawn. It will be understood, however, that the orientation could be reversed without detriment to the invention. Also, whilst a pin connector is shown at the uphole end and a box connector is shown at the downhole end of certain of the embodiments, the connector arrangement could be reversed, or alternatively the tool could have two pin connectors or two box connectors, as required in a particular application to connect to the other downhole components.

Figure 2:
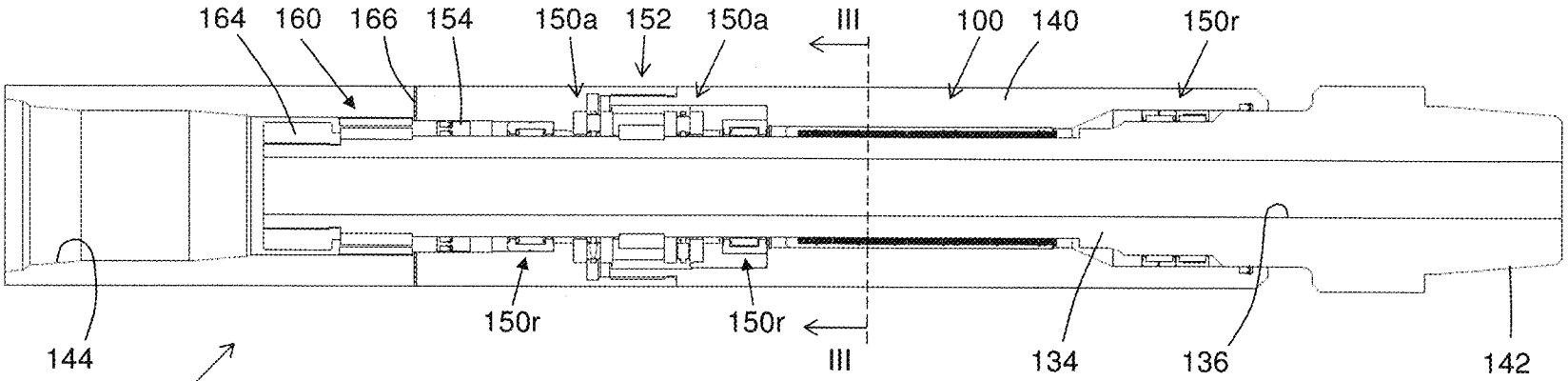
FIG. 2 shows a longitudinal sectional view of a first embodiment of high frequency torsional oscillation mitigation tool according to the invention.
Figure 3:
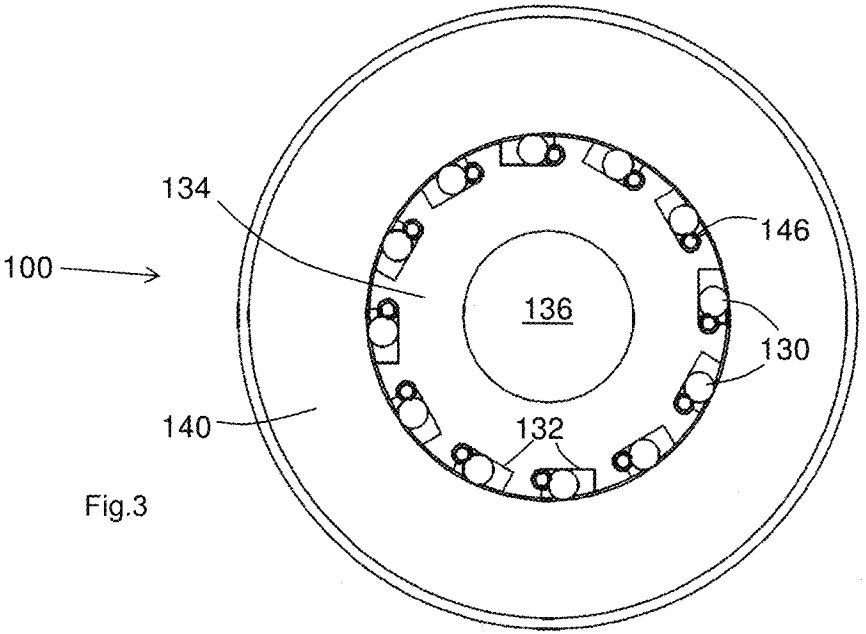
FIG. 3 shows a cross-section at III-III of the tool of FIG. 2.

The high frequency torsional oscillation mitigation tool 120 of FIGS. 2 and 3 incorporates a freewheel clutch 100 as the one-way coupling. The freewheel clutch 100 comprises a number of rolling elements or rollers 130 of circular cross-section, each of which is located in an inclined recess 132 in the body or central shaft 134 of the tool. The central shaft 134 is tubular and has an internal conduit 136 by which the mud can flow to the drill bit 16. The shaft 134 is closely surrounded by a sleeve 140. There is a small radial gap between the shaft 134 and the sleeve 140 which is provided to minimise any sliding contact during relative rotation of the shaft and sleeve.

The recesses 132 are inclined from a radially deeper end to a radially shallower end (the rollers 130 are all located at the deeper end of their respective recess in FIG. 3). The incline in this embodiment is curved and concave but could alternatively be linear or curved and convex. It is arranged that the distance between the deeper end of each recess 132 and the sleeve 140 is slightly greater than the diameter of the rollers 130 whereas the distance between the shallower end of each recess 132 and the sleeve 140 is slightly smaller than the diameter of the rollers 130. Accordingly, when the shaft 134 rotates clockwise as viewed in FIG. 3, each roller is urged up the incline of its recess 132 towards the shallower end and moves into engagement with the sleeve 140. It is arranged that the engagement of all of the rollers 130 with the sleeve 140 is sufficient to lock the sleeve 140 to the shaft 134 so that both components rotate together (i.e. the one-way coupling 100 is engaged).

It will be appreciated that the torque to rotate the drill bit is significant and the rollers 130 must accommodate that torque when locked to the sleeve 140, ideally without any relative rotation. The number and diameter of the rollers 130 is limited by the radial space within which the shaft 134 and sleeve 140 must be accommodated. The axial length is not so limited, however, and in order to accommodate the torque the rollers 130 are typically of significant length, perhaps 400 mm to 600 mm in a typical application.

The uphole pin connector 142 is connected rigidly to the shaft 134 (and in this embodiment is integral with the shaft 134). The downhole box connector 144 is rigidly connected to the surrounding sleeve 140 so that clockwise rotation of the shaft 134 as viewed in FIG. 3 (i.e. in the first direction) is communicated from the drill string 12 (or motor) to the rotary steerable tool 18 and the drill bit 16.

A resilient biasing means 146 is located in each of the recesses 132 to bias the rollers 130 up the incline of the recess 132, i.e. to help to ensure that the one-way coupling 100 is locked against relative rotation in the first direction. The resilient biasing means minimise backlash and enable the rollers to lock in the engaged condition quickly.

Figure 4:
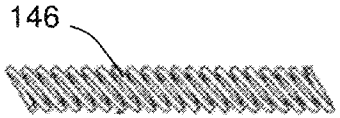
FIG. 4 shows a side view of part of the resilient biasing means of the tool of FIGS. 2 and 3.
Figure 11:
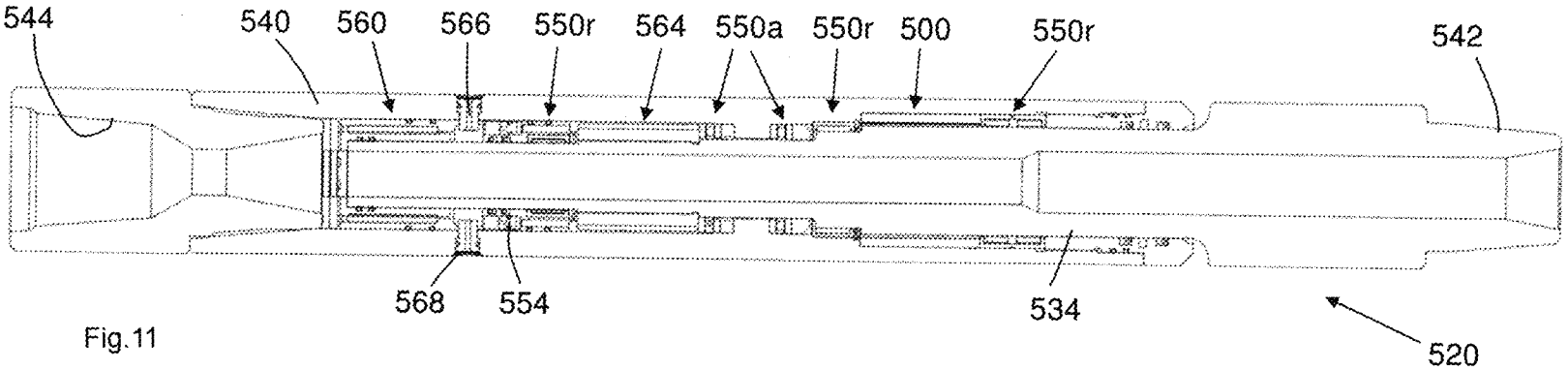
FIG. 11 shows a longitudinal sectional view of a fifth embodiment of high frequency torsional oscillation mitigation tool according to the invention.
Figure 12:
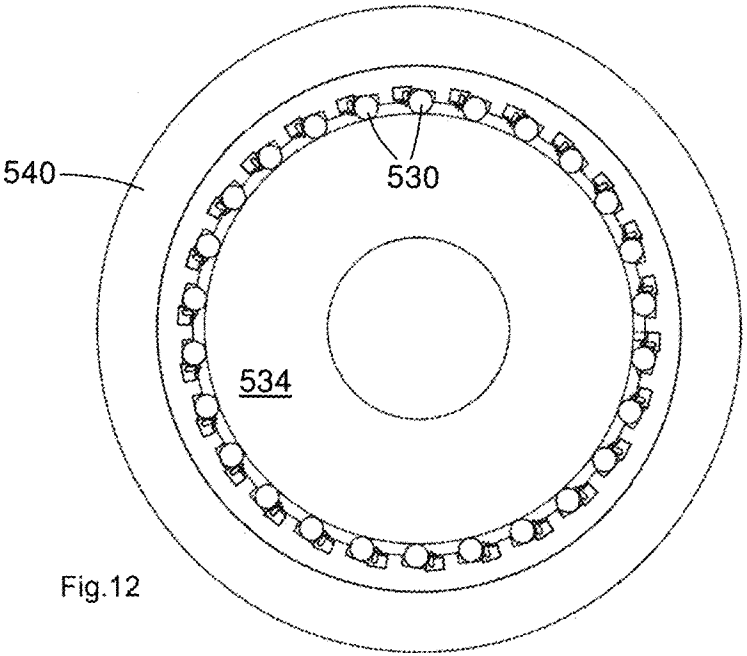
FIG. 12 shows a cross-section of the one-way coupling of the tool of FIG. 11.
Figure 13:
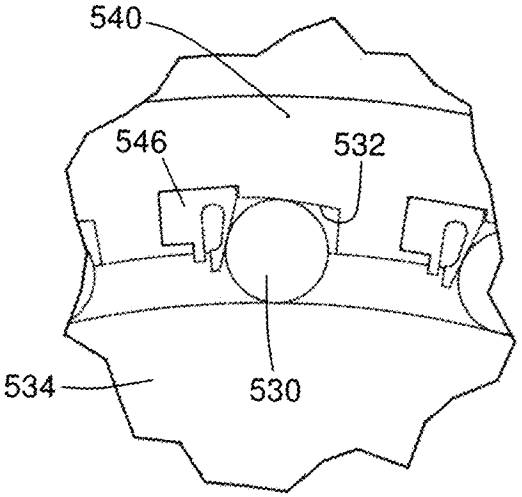
FIG. 13 shows an enlarged view of part of the cross-section of FIG. 12.
Figure 14:
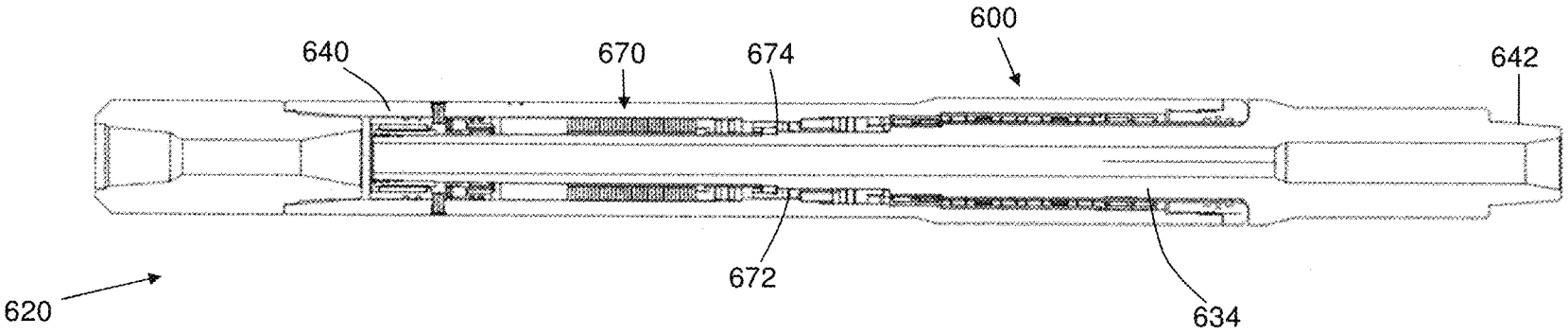
FIG. 14 shows a longitudinal sectional view of a sixth embodiment of high frequency torsional oscillation mitigation tool according to the invention.

FIG. 4 shows a side view of part of one embodiment of resilient biasing means 146, specifically a canted spring of metal. It will be understood that the canted spring can be flattened somewhat from the condition shown (i.e. compressed in the direction towards the bottom of the page) and will seek to return to the unstressed condition. It will also be understood that the canted spring can be made in any length, and in practical applications may substantially match the length of the rollers 130). Other resilient biasing means can alternatively be provided, including for example a folded metal (accordion) spring, or an elastomeric rod. Another alternative is a cantilever spring as shown in the embodiment of FIGS. 11-13, which could be used in the present embodiment instead of the canted spring (and vice versa).

When the shaft 134 rotates anti-clockwise as viewed in FIG. 3, each roller 130 is urged down the incline of its recess 132 towards the deeper end (with a force sufficient to overcome the resilient biasing means 146). The rollers 130 move out of engagement with the sleeve 140 and the sleeve does not rotate with the shaft 134. Relative rotation of the drill string 12 in this (second) direction is therefore not communicated to the rotary steerable tool 18 and the one-way coupling 100 is disengaged.

It is arranged that the one-way coupling is engaged during normal operation of the downhole assembly 10, i.e. with the drill string 12 rotating clockwise when viewed downhole towards the drill bit. The shaft 134 rotates with the drill string 12 in this first direction to communicate normal drilling rotation to the drill bit. Normal drilling rotation is also communicated to the rotary steerable tool 18 to permit the drill bit 16 to be steered in a chosen direction.

In the presence of high frequency torsional oscillation, the downhole assembly and part of the drill string will oscillate rapidly clockwise and anticlockwise at the resonant frequency/frequencies. During periods of reverse rotation (i.e. with the shaft 134 rotating anti-clockwise relative to the sleeve 140), the one-way coupling 100 disengages so that minimal torque and energy transfer occurs and subsequently the release of energy back into the downhole assembly (as part of the natural resonance phenomena) is reduced or prevented. The likelihood of damage to the downhole assembly is thereby reduced, which furthermore reduces the likelihood that damaging high frequency torsional oscillations will build up in the drill string 12.

The mitigation tool 120 of FIGS. 2 and 3 has two sets of axial bearings 150*a* and two sets of radial bearings 150*r*, one of each set to each side of a joint 152 of the tool housing. The joint 152 rigidly connects an end cap (which includes the sleeve 140) to the box connector 144 and is necessary for assembly of this embodiment of mitigation tool 120.

The sets of bearings 150*a,r*, and also the one-way coupling 100, are lubricated by oil which is isolated from the surrounding mud. A pressure equaliser or compensator 154 is provided, which can slide to balance the pressure of the oil with that of the surrounding mud, in known fashion. Other compensation systems could alternatively be used, e.g. a bladder or an array of smaller axial pistons in the toroidal space occupied by the illustrated balance piston.

The mitigation tool 120 also has a mud flow restrictor as is common to downhole tools which are lubricated by oil. It will be appreciated that the pressure of the mud within the internal conduit 136 (i.e. upstream of the drill bit 16) is significantly greater than the pressure of the mud in the annulus 22 surrounding the tool (i.e. downstream of the drill bit). The tool necessarily includes seals to separate the mud from the oil lubricant and it is preferable that the seals are not required to withstand the pressure differential between the internal conduit 136 and the annulus 22. The mud flow restrictor is provided to reduce the pressure differential across the relevant parts of the tool and thereby reduce the likelihood of a seal failure.

It will be seen that mud can pass around the outside of an end nut 164 adjacent to the box connector 144. The mud flow restrictor 160 is located between the end nut 164 and a conduit 166. The restrictor 160 and conduit 166 together provide a controlled mud leak path from the internal conduit 136 to the annulus 22. The compensator 154 is located adjacent to the conduit 166 and the mud pressure upon the compensator is therefore approximately the same as the pressure in the annulus 22. The pressure of the lubricating oil can therefore be compensated to the annulus pressure, in known fashion. The mud flow restrictor 160, which in this embodiment comprises an inner and outer ring with a very small clearance, is used to manage the pressure drop and flow rate of the mud, in a similar fashion to a mud lubricated radial bearing.

Figure 7:
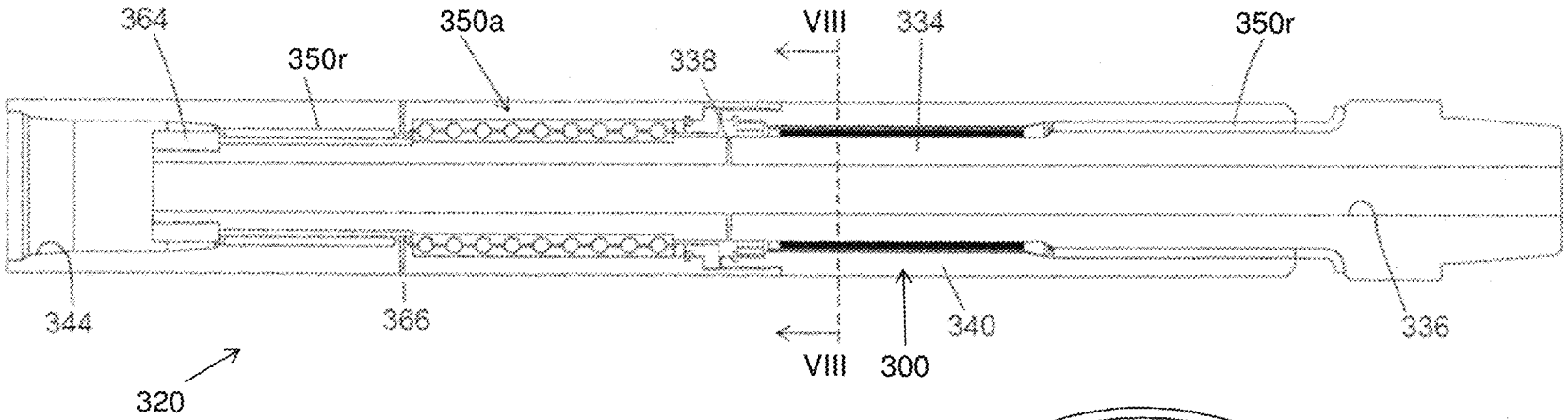
FIG. 7 shows a longitudinal sectional view of a third embodiment of high frequency torsional oscillation mitigation tool according to the invention.
Figure 8:
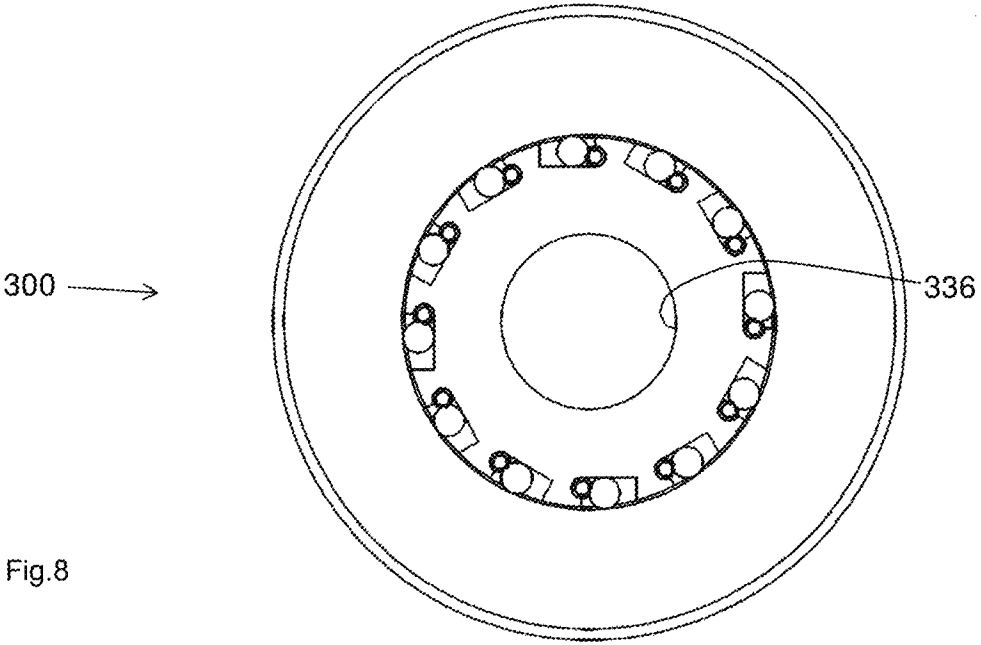
FIG. 8 shows a cross-section at VIII-VIII of the tool of FIG. 7.

It will be observed that in the embodiment of FIGS. 2 and 3 the recesses 132 are formed in the shaft 134 (and similarly in the embodiment of FIGS. 7-8). The embodiment of FIGS. 11-13 shows the opposite arrangement in which the recesses are formed in the surrounding sleeve 140. The two options are interchangeable in each embodiment.

Figure 5:
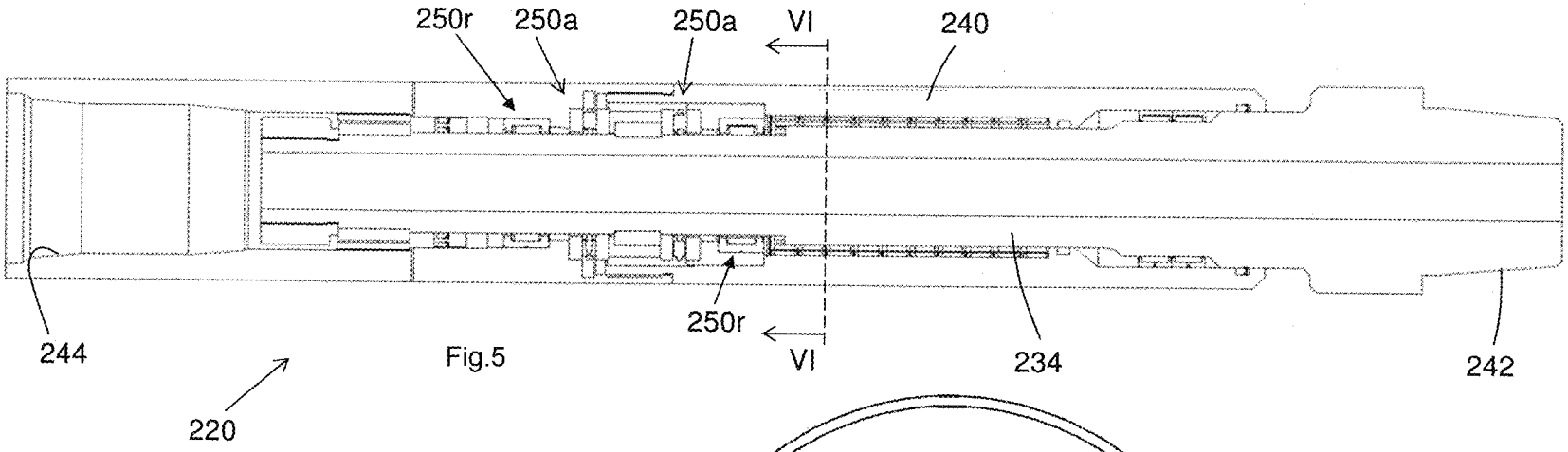
FIG. 5 shows a longitudinal sectional view of a second embodiment of high frequency torsional oscillation mitigation tool according to the invention.
Figure 6:
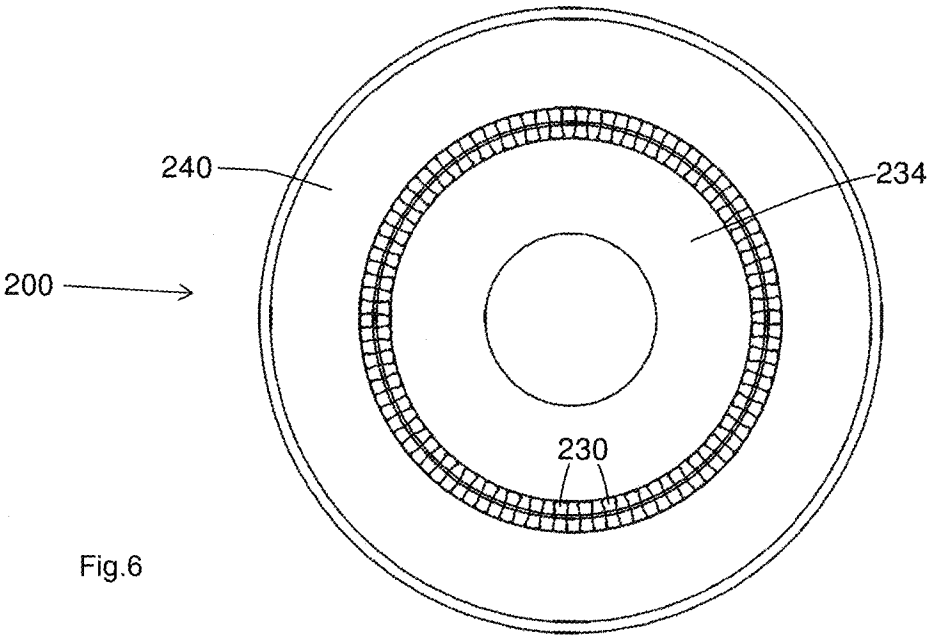
FIG. 6 shows a cross-section at VI-VI of the tool of FIG. 5.

The high frequency torsional oscillation mitigation tool 220 of FIGS. 5 and 6 differs from that of FIGS. 2 and 3 in using a one-way coupling in the form of a sprag clutch, the sprag clutch and bearings being lubricated by oil which is isolated from the mud. A suitable sprag clutch type is the "cage freewheel SF" available from Ringspann GmbH (see the website www.ringspann.com).

The sprag clutch 200 is shown in more detail in the cross-sectional view of FIG. 6. In known fashion, a set of driving elements or sprags 230 are located in an annular gap between the shaft 234 and the sleeve 240. The sprags have a major dimension which is larger than the annular gap, and a minor dimension which is smaller than the annular gap. It will be understood that when the shaft 234 rotates relative to the sleeve in a chosen direction (in this embodiment the clockwise direction as viewed in FIG. 6), the sprags are driven to rotate so that their major axes are more closely aligned with the radial direction. The sprags 230 become wedged between the shaft 234 and sleeve 240 and can transmit torque from the shaft 234 to the sleeve 240. Relative rotation in the opposing direction, however (corresponding to anti-clockwise rotation of the shaft 234 as viewed in FIG. 6) causes the individual sprags 230 to rotate so that their major axes are less closely aligned with the radial direction (i.e. the sprags 230 rotate to an orientation with a smaller radial dimension). The sprags 230 will no longer be in driving contact with the shaft and/or sleeve and the sleeve 234 can rotate relative to the shaft 240. It will be seen that in this embodiment the uphole pin connector 242 is rigidly connected to the shaft 234 whereas the downhole box connector 244 is rigidly connected to the sleeve 240.

The embodiment of FIGS. 5 and 6 also uses sets of axial and radial bearings 250*a,r*. In this embodiment each set of bearings comprises needle roller bearings 250*r* for radial support, but could alternatively use plain bearings, or a combination thereof.

The detailed operation of the tool 220 of FIGS. 5 and 6 matches that of the tool 120 and will not be repeated.

The high frequency torsional oscillation mitigation tool 320 of FIGS. 7 and 8 differs from the embodiment of FIGS. 2 and 3 in using mud to lubricate the one-way coupling and the bearing structures.

The tool 320 has an internal conduit 336 for the passage of mud from the surface to the drill bit 16. Inlet conduits 338 connect the internal conduit 336 to a location between the one-way coupling 300 and the axial bearings 350*a*. The mud pressure differential between the internal conduit 336 and the annulus 22 causes some of the mud to flow from the inlet conduit 338 in an uphole direction past the one-way coupling 300 and the upper radial bearing 350*r* before passing to the annulus 22 surrounding the tool. The remainder flows in a downhole direction through the axial bearing 350*a* and out of the tool by way of the outlet conduits 366.

Mud also flows from the internal conduit 336 around an end nut 364 located at the box connector 344, past the lower radial bearing 350*r* and out to the annulus 22 through the outlet conduits 366.

Accordingly, a small proportion (typically between approx. 1% and approx. 5%) of the mud flowing along the internal conduit 336 is diverted to lubricate the one-way coupling 300 and the bearings 350*a,r* of the tool 320.

As seen in FIG. 8, in this embodiment the one-way coupling 300 is similar to that of the embodiment of FIGS. 2 and 3 but that is not necessarily the case and other embodiments can utilise different one-way couplings suitable for a mud-lubricated system.

Figure 9:
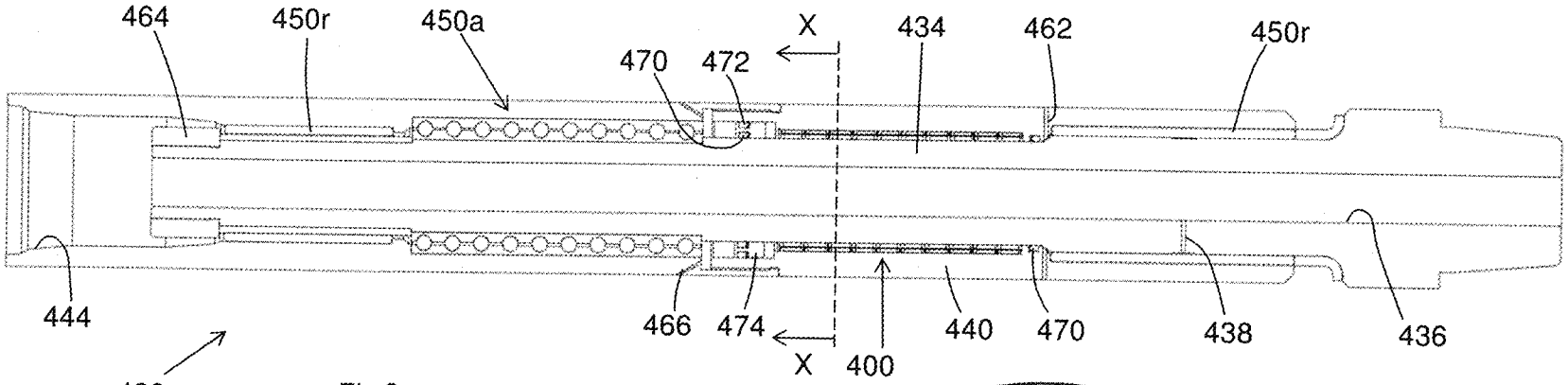
FIG. 9 shows a longitudinal sectional view of a fourth embodiment of high frequency torsional oscillation mitigation tool according to the invention.
Figure 10:
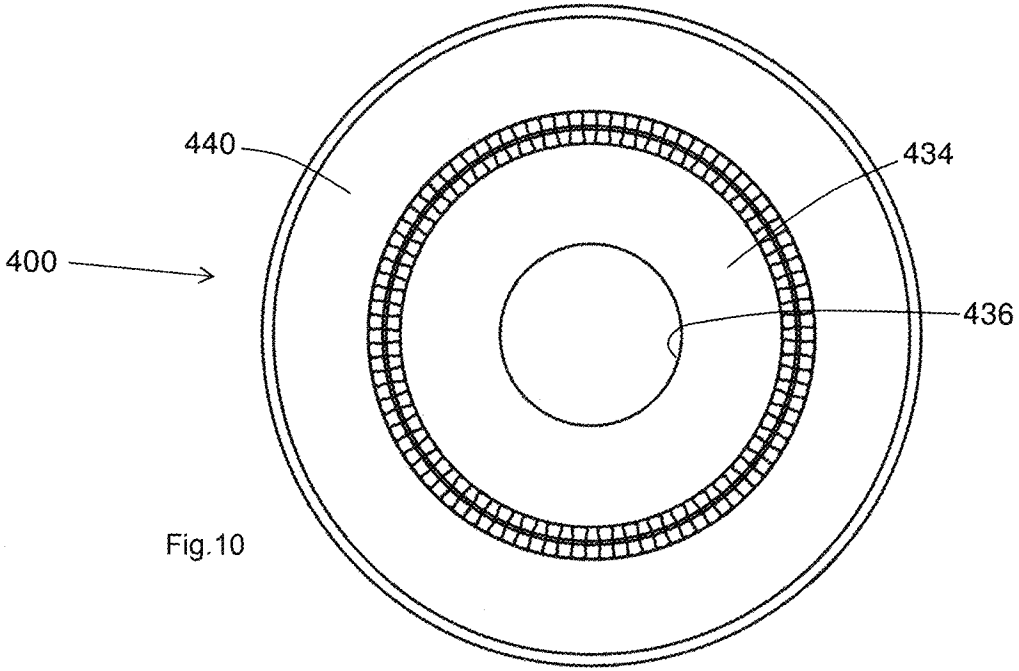
FIG. 10 shows a cross-section at X-X of the tool of FIG. 9.

The high frequency torsional oscillation mitigation tool 420 of FIGS. 9 and 10 differs from the embodiment of FIGS. 4 and 5 primarily in using mud to lubricate the bearing structures. Oil is used to lubricate the sprag clutch 400 as in the embodiment of FIGS. 5 and 6.

The tool 420 has an internal conduit 436 for the passage of mud from the surface to the drill bit 16. An inlet conduit 438 connects the internal conduit 436 to an upper radial bearing 450*r*. Some of this mud passes in an uphole direction to the annulus 22. The remainder passes in a downhole direction to outlet conduits 462 which allow the mud to flow into the annulus 22.

Mud can also flow from the internal conduit 436 around an end nut 464 located at the box connector 444, through the lower radial bearing 450*r* and the axial bearing 450*a*. This mud lubricates the bearings 450*r* and 450*a* and passes through outlet conduits 466 to the surrounding annulus 22.

Accordingly, a small proportion of the mud flowing along the internal conduit 436 is diverted to lubricate the radial bearings 450*r* and the axial bearings 450*a*. The radial bearing 450*r* also acts as a mud flow restrictor so that the mud pressure acting upon the compensator 474 is close to that of the annulus 22.

The one-way coupling (which in this embodiment is a sprag clutch 400) is isolated from the mud by a combination of rotating seals 470 and static seals 472 and by the pressure compensator 474.

FIGS. 11-13 shows another alternative embodiment of mitigation tool 520 according to the invention.

In this embodiment the recesses 532 are formed in the sleeve 540. The driving elements or rollers 530 therefore move inwardly towards the shaft 534 to the engaged condition (and outwardly to the disengaged condition), as compared to the earlier embodiments. For a given tool diameter the recesses 532 and rollers 530 can therefore be located at a slightly greater radius, and spread over a slightly greater circumferential length, which can permit an increase in the number of rollers 530.

The resilient biasing means in this embodiment is a cantilever spring 546, the profile of which can be better seen in the enlarged view of FIG. 13. Each cantilever spring 546 sits in a pocket of the recess 532 and biases the roller 530 towards the shallower end of the recess.

The detailed form of the cantilever spring 546 can be varied from that shown to suit the particular application. It will be understood that it is only necessary for the tool manufacturer to determine a suitable profile and material for the cantilever springs 546 and they can be made to any required length, ideally to match the full length of the rollers 530. It will also be understood that the cantilever spring (as with all forms of the resilient biasing means for the rolling elements) does not need to match the full length of the rollers and separate spring elements can be provided along the rollers if desired.

It will be understood that the general form of the recesses 532 and the general operation of the rollers 530, are as described previously and will not be repeated.

The arrangement of the components of the mitigation tool 520 are modified somewhat as compared to the embodiment of FIGS. 2 and 3, which in certain applications can make the tool easier to manufacture and assemble/disassemble. The modifications can also make the tool more durable and reliable. The modifications are all optional and are shown to demonstrate some of the variety of options for the detailed structure which can be utilised in practice.

The mitigation tool 520 of FIGS. 11-13 has two sets of axial bearings 550*a* and three sets of radial bearings 550*r*. The sets of bearings 550*a,r* and the one-way coupling 500 are lubricated by oil which is isolated from the surrounding mud.

The mitigation tool 520 has a mud flow restrictor 560 and "leak" conduits 566. In this embodiment the conduits 566 are provided by a component 568 which is secured in the sleeve 540. The components 568 are of hardened steel or tungsten carbide and are removable; the components 568 can therefore be replaced when they become eroded due to mud flow through the conduits 566.

The compensator 554 is located adjacent to the components 568.

The securing nut 564 by which the sleeve 540 is secured to the shaft 542 is located inwardly of the compensator 554.

FIGS. 14-18 show a further modified mitigation tool 620 with additional (optional) functionality. Specifically, this embodiment has a locking mechanism in addition to the one-way coupling, which locking mechanism might be required for example if the drill bit or another part of the downhole assembly becomes stuck in the borehole.

It is not intended that the locking mechanism is actuated during normal operation, and it is expected that in many drilling operations the locking mechanism will never be required and the mitigation tool will operate as above described. However, in the event that the drill bit or another part of the downhole assembly becomes stuck the operator may wish to impart more torque to the drill string than the one-way coupling can accommodate, and the locking mechanism provides a predetermined torque capacity which can be significantly greater than that of the one-way coupling.

The mitigation tool 620 includes a one-way coupling 600, and which can correspond to the detailed structure of any of the embodiments described above. The one-way coupling 600 and its associated bearings, seals etc. can therefore be similar to any of the earlier embodiments and a detailed description of that part of the tool 620 will not be repeated. The difference with the previously-discussed mitigation tools is, however, that the tool, and in particular the one-way coupling, can accommodate axial movement of the central shaft 634 relative to the surrounding sleeve 640. The relative axial movement does not need to be large, and a range of relative axial movement of 6 mm to 15 mm is expected to be sufficient for most tools (and depending upon the size of the tool).

Alongside the one-way coupling 600 the tool 620 has resilient biasing means in the form of a stack of disc springs 670. The disc springs 670 bias the central shaft 634 axially relative to the sleeve 640, to a normal (unlocked) condition. The disc springs 670 are sufficiently strong that during normal drilling operations, and proper operation of the mitigation tool 620, the shaft 634 does not move axially relative to the sleeve and the locking mechanism remains unlocked.

Figure 16:
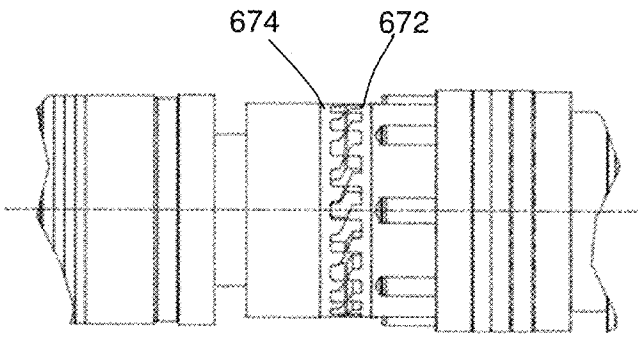
FIG. 16 shows a side view of part of the locking mechanism of the tool of FIG. 14, in the unlocking condition.
Figure 15:
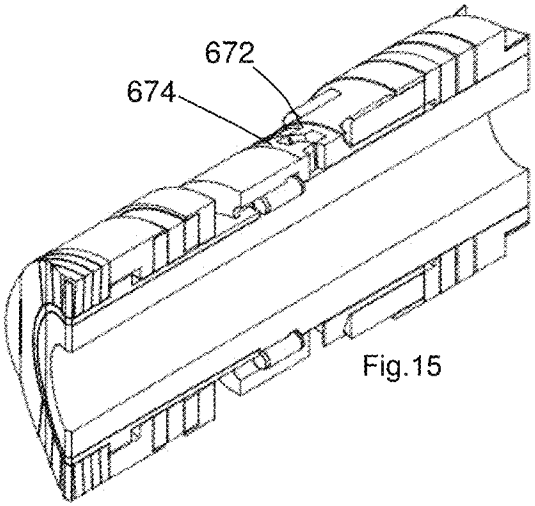
FIG. 15 shows a sectional perspective view of part of the locking mechanism of the tool of FIG. 14, in the unlocking condition.

It will be seen from FIGS. 15 and 16 that the tool 620 has a pair of interlocking elements, in this embodiment in the form of aligned dog gears 672 and 674. The dog gears 672 and 674 do not engage in normal operation and in particular the springs 670 act to bias (and keep) the gears apart. The dog gears 674 are rigidly connected to the central shaft 634 and the dog gears 672 are rigidly connected to the surrounding sleeve 640. Operation of the one-way coupling 600 is therefore accompanied by relative rotation of the gears 672, 674.

In the event that a part of the downhole assembly below the mitigation tool 620 become stuck in the borehole 14, the operator will apply an overpull to the drill string 12, i.e. pulling the uphole pin connector 642 towards the right as viewed. That overpull will cause the stack of disc springs 670 to compress and the gears 672, 674 to enmesh. The gears 672 and 674 have tapered or sloping surfaces to help ensure proper meshing of the gears.

Figure 18:
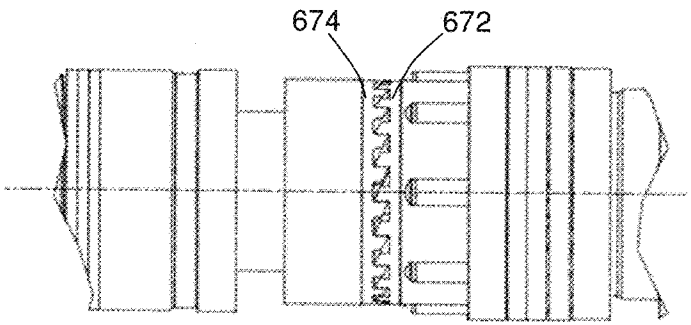
FIG. 18 shows a side view of part of the locking mechanism of the tool of FIG. 14, in the locking condition.
Figure 17:
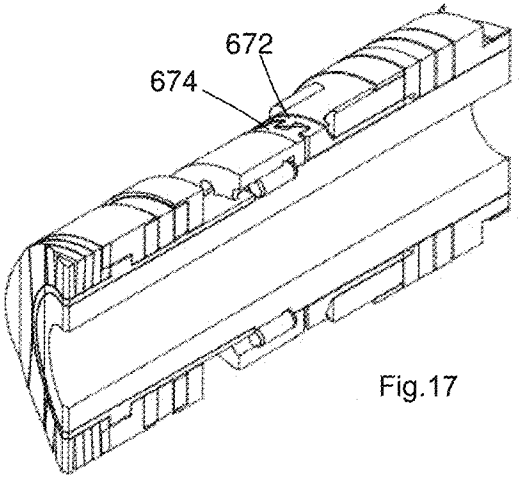
FIG. 17 shows a sectional perspective view of part of the locking mechanism of the tool of FIG. 14, in the locking condition.

The tool 620 therefore moves to the condition shown in FIGS. 17-18 in which the gears 672 and 674 are meshed. In this locked condition the rotation of the drill string 12 is communicated directly from the uphole pin connector 642 to the downhole box connector 644 (and consequently to the rotary steerable tool and drill bit) and the one-way coupling 600 is overridden or bypassed. The operator can seek to release the stuck component by way of the overpull alone, or in addition by rotating the drill string 12. The locking mechanism allows the operator to apply a torque up to the limit of the dog gears 672, 674, which in practical applications will far exceed the torque which the one-way coupling 600 can withstand.

Figure 19:
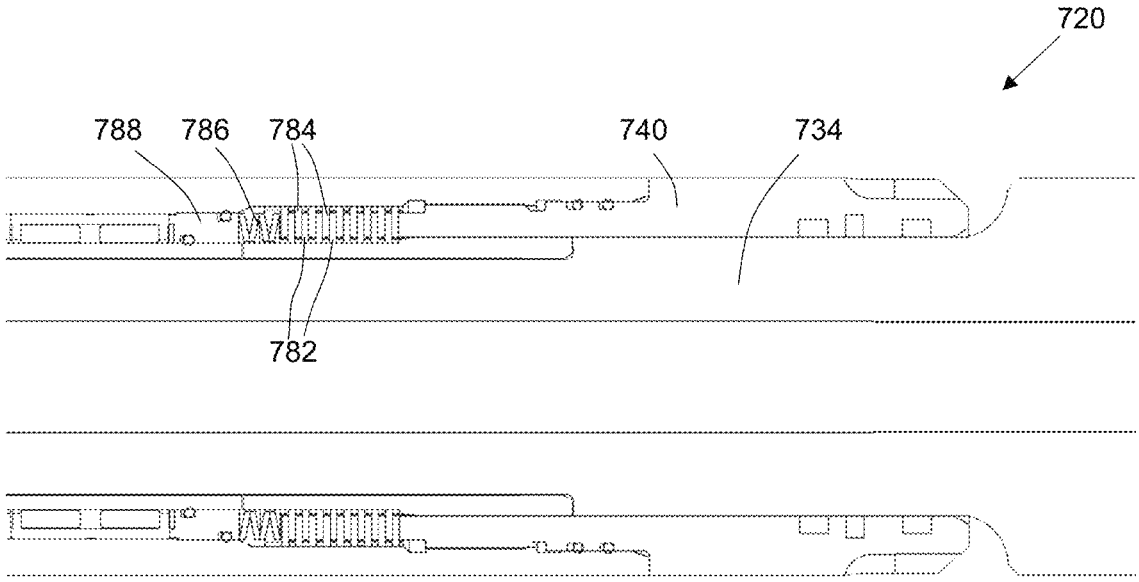
FIG. 19 shows a part of a seventh embodiment of high frequency torsional oscillation mitigation tool according to the invention, including a mechanical damping mechanism.

FIG. 19 shows a part of a mitigation tool 720. This embodiment has the additional functionality of a damping mechanism to minimise the shock loading when the tool transfers from its disengaged condition to its engaged condition. The damping mechanism 780 comprises a mechanical clutch, with a first set of (inner) annular clutch plates 782 mounted to the shaft 734 and a second set of (outer) annular clutch plates 784 mounted to the sleeve 740. Preload springs 786 are located between an endmost clutch plate and a seal housing 788, the preload spring biasing the clutch plates together. It will be understood that during normal operation of the mitigation tool 720 the one-way coupling (not shown) is in its engaged condition and the shaft and sleeve rotate together so that there is no relative rotation between the clutch plates 782 and 784. However, when the one-way coupling is in its disengaged condition the sleeve rotates relative to the shaft and there is corresponding rotation between the clutch plates 782 and 784. The damping mechanism therefore allows a proportion of the total torque to be transmitted from the shaft to the sleeve even when the one-way coupling is disengaged, thereby reducing the relative change in torque as the one-way clutch becomes engaged.

Figure 20:
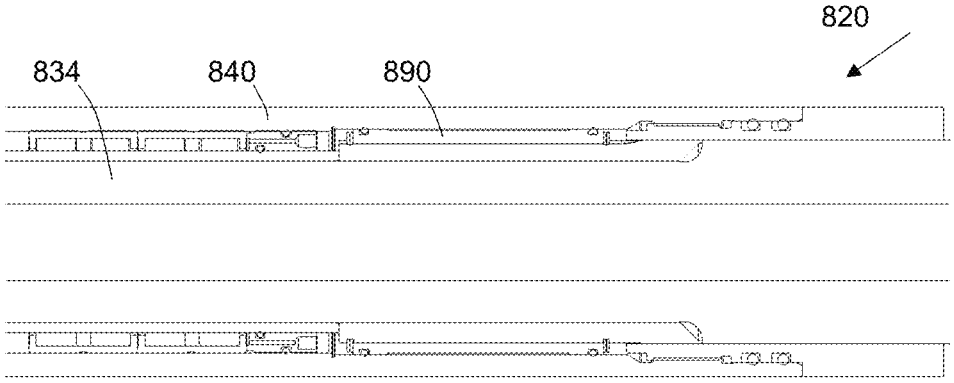
FIG. 20 shows a part of an eighth embodiment of high frequency torsional oscillation mitigation tool according to the invention, including a fluid damping mechanism.
Figure 21:
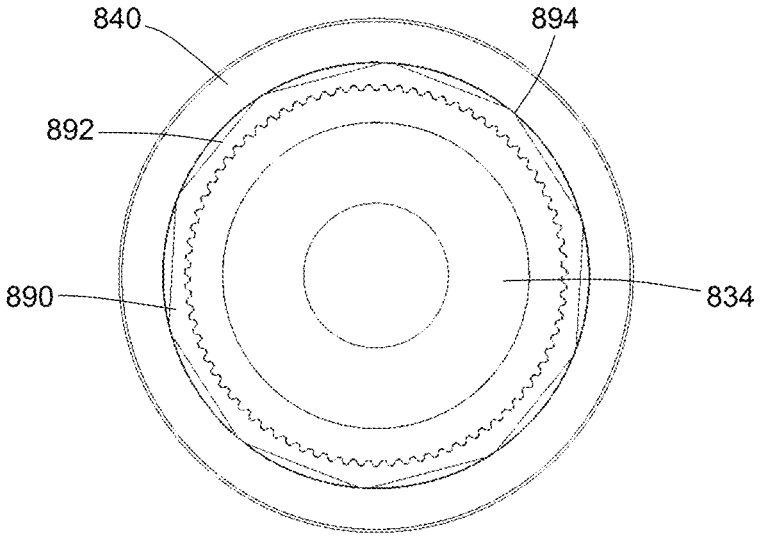
FIG. 21 shows a cross-sectional view through the fluid damping mechanism of FIG. 20.

FIG. 20 shows part of another embodiment of mitigation tool, with a fluid damper. A cross-sectional view of the fluid damper is shown in FIG. 21 and a perspective view of the inner part 890 of the fluid damper is shown in FIG. 22.

Figure 22:
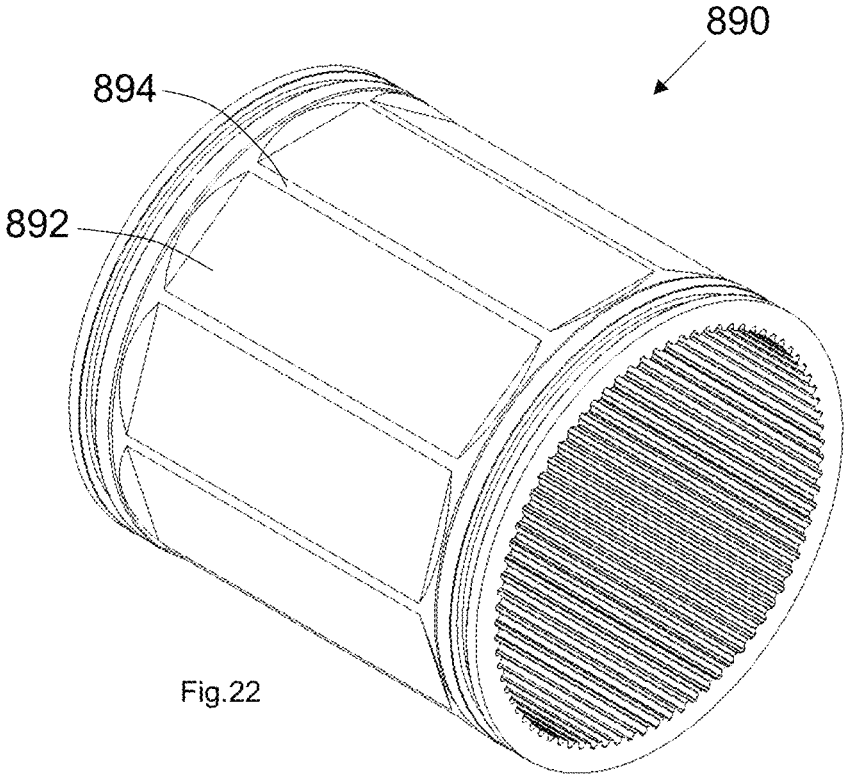
FIG. 22 shows a perspective view of a part of the fluid damping mechanism.

As seen in FIG. 22, the inner part 890 of fluid damper is formed as a collar adapted to fit over a part of the shaft 834 of the mitigation tool 820. Cooperating splines ensure that the inner part 890 rotates with the shaft 834. The outer surface of the inner part has a series of flats 892 separated by peaks 894. As seen in FIG. 21, in the assembled mitigation tool the inner part 890 lies within an outer part of the fluid damper, the outer part being a section of the sleeve 840. The inner surface of the outer part of the fluid damper is of circular cross-section. There is a very small radial gap between each of the peaks 894 and the inner surface, the radial gap increasing towards the centres of the flats 892.

A viscous fluid fills the gap between the inner and outer parts of the fluid damper. It will be understood that when the one-way clutch is disengaged the shaft 834 rotates relative to the sleeve 840 and there is corresponding rotation between the inner and outer parts of the fluid damper. The fluid damper resists that relative rotation in known fashion, firstly because of the shear forces in the small gap between the inner and outer parts, and secondly because some of the fluid is forced through the small gaps between the peaks 894 and the inner surface of the outer part. In common with many known fluid dampers the resistance to relative rotation is related to the rate of relative rotation—the faster the damper seeks to move the fluid the greater the resistance to movement.

It will be understood that the relative degree of rotation between the shaft 834 and the sleeve 840 as the mitigation tool re-engages is relatively small and so the gaps between the peaks 894 and the inner surface of the outer part of the damper must be very small in a practical tool.

It will also be understood that the damping mechanisms of FIGS. 19-22 operate equally for relative rotations in both directions. In a practical tool it may be desirable for the damping mechanism to operate differently in each direction. Thus, it may be desired for there to be little or no damping as the parts rotate relatively from their engaged condition to their disengaged condition so that the mitigation tool can react quickly to a high frequency torsional oscillation. A high degree of damping may be desired as the parts rotate from their disengaged condition to their engaged condition in order to protect the downhole components from shock loading as the one-way coupling re-engages. Many different designs of fluid damper in particular can be made to react differently to relative rotations in different directions, for example by allowing for an alternative flow path for the viscous fluid in a chosen direction of relative rotation.

It will be understood that the damping mechanism could alternatively incorporate a flexible and resilient material. It will also be understood that a damping mechanism can be used in any of the other embodiments described.

FIGS. 3 and 8 show the recesses formed directly in the respective shaft and FIG. 13 shows the recesses formed directly in the sleeve. It will be understood, however, that the shafts of FIGS. 3 and 8 could be made smaller with a collar fitted around the outside of the shaft. Similarly, the sleeve of FIG. 13 could be made larger with a collar fitted inside the sleeve. The recesses could then be formed in the collar before it is mounted to the shaft or sleeve respectively, it being easier to machine a collar than the entire shaft or sleeve. Such embodiments would also enable the collar to be of relatively hard material suited to the one-way clutch whilst permitting the shaft and/or sleeve to be of softer material.

Also, whilst the described embodiments have continuous recesses along the full length of the tool, in other embodiments the recesses can be discontinuous. In either case it is not necessary that the shaft, sleeve or collar in which the recesses are formed is continuous and a set of shorter shaft elements, sleeve elements or collar elements as applicable can be utilised. Thus, whilst the first aspect of the invention requires multiple sets of driving elements along the longitudinal axis of the tool, it will be understood that multiple sets of recess elements can also be provided along the longitudinal axis of the tool (and corresponding multiple sets of shaft elements, sleeve elements or collar elements in which those recess elements are formed).

In embodiments having multiple sets of recesses along the longitudinal axis of the tool, neighbouring recesses can be aligned along the tool whereby to provide effectively continuous recesses. Alternatively, neighbouring recesses can be misaligned (e.g. staggered) whereby the rolling element(s) in one recess is(are) isolated from their neighbouring rolling element(s). Furthermore, the detailed structure of the recess elements can be consistent along the length of the tool, or the detailed structure can differ along the tool, the latter perhaps varying the torque transfer at different points along the length of the tool if required to enable a more uniform torque transfer to be achieved over the complete length of the tool.

As regards the bearings used in the various embodiments, it is generally understood that ball bearing type thrust bearings are generally more suitable for the larger tolerances and clearances which are typically necessary in a mud lubricated system. Conversely, plain bearing type bushes are generally more suitable as radial bearings in mud lubricated applications. It is not excluded that the bearings of certain of the embodiments could be used in other embodiments, depending on their positions relative to the oil/mud sealing members.

It will be seen that the sets of axial or thrust bearings 150*a*, 250*a*, 350*a*, 450*a*, 550*a* are all located below the respective one-way couplings 100, 200, 300, 400, 500. It is possible to provide the axial bearings (or additional sets of axial bearings) above the respective one-way couplings if desired, but that is not expected to be necessary in practice.

The invention claimed is:

1. A high frequency torsional oscillation mitigation tool comprising:

a first end, a second end, a one-way coupling between the first end and the second end, a first connector at the first end, a second connector at the second end, wherein the one-way coupling comprises a first part and a second part, the first part being connected to rotate with the first connector and the second part being connected to rotate with the second connector, wherein the one-way coupling further has an engaged condition in which the first part and the second part can rotate together in a first rotational direction, and a disengaged condition in which the first part can rotate relative to the second part in a second rotational direction, a longitudinal axis with a set of driving elements around the longitudinal axis and multiple sets of driving elements along the longitudinal axis.

2. The high frequency torsional oscillation mitigation tool according to claim 1, wherein the first part is a shaft and the second part is a sleeve surrounding the shaft.

3. The high frequency torsional oscillation mitigation tool according to claim 1, wherein each driving element of the set of driving elements is a rolling element with a consistent rolling radius.

4. The high frequency torsional oscillation mitigation tool according to claim 3, wherein each rolling element of said set of driving elements is located in a recess.

5. The high frequency torsional oscillation mitigation tool according to claim 4, wherein the first part is a shaft and the second part is a sleeve surrounding the shaft, and in which a number of recesses is located in a collar mounted to one of the sleeve and the shaft, each recess of the number of recesses comprising a floor which is inclined from a radially shallower end to a radially deeper end.

6. The high frequency torsional oscillation mitigation tool according to claim 5, wherein each said rolling element projects from its respective recess when located at the radially shallower end.

7. The high frequency torsional oscillation mitigation tool according to claim 5, further comprising a radial gap between the shaft and the sleeve, and in which each said rolling element extends across the radial gap when located at the radially shallower end of its recess.

8. The high frequency torsional oscillation mitigation tool according to claim 5, wherein each said rolling element is engaged by a resilient biasing means, the resilient biasing means urging the rolling element towards the radially shallower end of its recess.

9. The high frequency torsional oscillation mitigation tool according to claim 8, wherein the resilient biasing means is a cantilever spring.

10. The high frequency torsional oscillation mitigation tool according to claim 1, wherein at least part of the high frequency torsional oscillation mitigation tool is lubricated by a fluid which surrounds the high frequency torsional oscillation mitigation tool in use.

11. The high frequency torsional oscillation mitigation tool according to claim 1, wherein at least a part of the high frequency torsional oscillation mitigation tool is lubricated by oil, in which the oil is isolated from a fluid which surrounds the high frequency torsional oscillation mitigation tool in use, and in which the high frequency torsional oscillation mitigation tool has a flow path for the fluid, the flow path including a flow restrictor.

12. The high frequency torsional oscillation mitigation tool according to claim 11, further comprising a pressure compensator, the pressure compensator being in communication with the flow path downstream of the flow restrictor.

13. The high frequency torsional oscillation mitigation tool according to claim 1, further comprising a damping mechanism between the first part and the second part.

14. The high frequency torsional oscillation mitigation tool according to claim 13, wherein the damping mechanism is a mechanical clutch,
a fluid damper, or
a resilient material damper.

* * * * *